US007587975B2

(12) United States Patent
Natsume et al.

(10) Patent No.: US 7,587,975 B2
(45) Date of Patent: Sep. 15, 2009

(54) EMBOSSED SHEET FORMING APPARATUS AND ROTARY PHASE DIFFERENCE CONTROL METHOD

(75) Inventors: Tsutomu Natsume, Odawara (JP); Takayuki Hisajima, Numazu (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 223 days.

(21) Appl. No.: 11/404,798

(22) Filed: Apr. 17, 2006

(65) Prior Publication Data

US 2006/0236878 A1 Oct. 26, 2006

(30) Foreign Application Priority Data

Apr. 21, 2005 (JP) ..... 2005-123749

(51) Int. Cl.
*B31F 1/07* (2006.01)
*B41F 13/24* (2006.01)

(52) U.S. Cl. ..... 101/23; 101/6; 101/32; 101/248; 101/486

(58) Field of Classification Search ..... 101/11, 101/23, 216, 3.1, 5, 6, 32, 248, 485, 486
See application file for complete search history.

(56) References Cited

U.S. PATENT DOCUMENTS 3,268,905 A * 8/1966 Neitzel et al. ..... 346/33 R
3,276,647 A * 10/1966 Lewis, Jr. et al. ..... 226/31
3,749,626 A * 7/1973 Buck ..... 156/251
4,885,785 A * 12/1989 Reynolds et al. ..... 382/112
5,109,767 A 5/1992 Nyfeler et al.
5,740,054 A * 4/1998 Durr et al. ..... 700/122
6,082,161 A 7/2000 Marushita et al.
6,092,466 A * 7/2000 Koch et al. ..... 101/485
6,837,159 B2 * 1/2005 Elkotbi et al. ..... 101/219
6,932,528 B2 * 8/2005 Heiles et al. ..... 400/621

(Continued)

FOREIGN PATENT DOCUMENTS

CA 2026027 3/1991

(Continued)

OTHER PUBLICATIONS

Search Report issued in counterpart Taiwanese Application No. 095113458, mailed Jan. 31, 2008.

(Continued)

*Primary Examiner*—Ren Yan
(74) *Attorney, Agent, or Firm*—DLA Piper LLP (US)

(57) ABSTRACT

An embossed sheet forming apparatus has phase controlling means (33, 34) axially shifting a second embossing roller 11, a front embossed profile detector 74 for detecting an embossed profile on a front surface of a both-sided embossed sheet 100, a rear embossed profile detector 75 for detecting an embossed profile on the rear surface, both surfaces phase difference computing means 80 comparing a detection signal from the front embossed profile detector 74 and a detection signal from the rear embossed profile detector 75 for calculating an embossing phase difference in a sheet width direction between the embossed profiles on the both surfaces, and phase adjustment control processing means 77 inputting a phase difference signal representing the embossing phase difference from the both surfaces phase difference computing means 80 for outputting a command to the phase controlling means (33, 34) to cancel a deviation of the phase difference.

4 Claims, 5 Drawing Sheets

U.S. PATENT DOCUMENTS

| | | | | |
|---|---|---|---|---|
| 2003/0053828 | A1 * | 3/2003 | Yagi et al. | 399/301 |
| 2003/0075269 | A1 * | 4/2003 | Prix et al. | 156/277 |
| 2005/0132904 | A1 * | 6/2005 | Basler et al. | 101/23 |

FOREIGN PATENT DOCUMENTS

| | | | |
|---|---|---|---|
| JP | 60048356 | A * | 3/1985 |
| JP | 60250956 | A * | 12/1985 |
| JP | 10034748 | | 2/1998 |
| JP | 2001-071307 | * | 3/2001 |
| JP | 2004-142182 | | 5/2004 |
| TW | 418121 | | 1/2001 |
| TW | 439655 | | 6/2001 |
| TW | 522057 | | 3/2003 |

OTHER PUBLICATIONS

Partial English Language Translation of Search Report issued in counterpart Taiwanese Application No. 095113458, mailed Jan. 31, 2008.
English language abstract of TW 439655, published Jun. 7, 2001.
English language abstract of TW 522057, published Mar. 1, 2003.
English language abstract of TW 418121, published Jan. 11, 2001.
English language abstract of JP 2004-142182, published May 20, 2004.
Machine translation of JP 2004-142182, May 20, 2004.
English language abstract of JP 10-034748, published Feb. 10, 1998.
Machine translation of JP 10-034748, Feb. 10, 1998.
Chinese Office Action issued in Application No. 200610077756.1 mailed Jun. 6, 2008.
Translation of Chinese Office Action issued in Application No. 200610077756.1 mailed Jun. 6, 2008.
Korean Office Action issued Jan. 19, 2007 for counterpart Korean Application 10-2006-35533.
English Translation of Korean Office Action issued Jan. 19, 2007 for counterpart Korean Application 10-2006-35533.
Machine translation for JP 2001-71307, Mar. 21, 2001.
English language abstract of JP 2001-071307, published Mar. 21, 2001.
Chinese Office Action issued in Chinese Application No. 200610077756.1, mailed May 8, 2009.
English language translation of Chinese Office Action issued in Chinese Application No. 200610077756.1, mailed May 8, 2009.

* cited by examiner

EMBOSSED SHEET FORMING APPARATUS AND ROTARY PHASE DIFFERENCE CONTROL METHOD

BACKGROUND OF THE INVENTION

The present invention relates to embossed sheet forming apparatuses and related rotary phase difference control methods and, more particularly, to an embossed sheet forming apparatus and a related rotary phase difference control method for forming an optical high-precision both-sided embossed sheet.

An optical high-precision both-sided embossed sheet such as a lenticular sheet for use in a rear projector screen has front and rear surfaces, both of which are formed with embossed patterns. Such a both-sided embossed sheet is, as disclosed in Japanese Patent Provisional Publication No. 2004-142182, formed by an extrusion molding method using an embossed sheet forming apparatus. This embossed sheet forming apparatus includes two embossing rollers, having outer peripheries engraved with patterns, which are juxtaposed in parallel with each other.

The embossed sheet forming apparatus has issues as follows: When the embossed sheet forming apparatus is continuously operated, since the respective rolling speeds of the two embossing rollers are fluctuated, the speed ratio (draw ratio) of the two embossing rollers is also fluctuated. Consequently, the rotary phase difference of the two embossing rollers is fluctuated. The fluctuation of such a rotary phase difference (rotary phase deviation), as shown in FIG. 1A, causes swell-like deviation (embossing phase deviation) to occur in the embossing phase difference of front and rear surfaces of the both-sided embossed sheet along a roller axis direction (sheet width direction).

In FIG. 1A, "LPs1" denotes the embossing phase of the front surface of the both-sided embossed sheet in a roller axis direction; "LPs2" the embossing phase of the rear surface of the both-sided embossed sheet in the roller axis direction; and "A" the phase difference of the phases LPs1 and LPs2. The phase difference A shows that it cyclically and widely fluctuates the embossing phase deviation of the front and rear surfaces along the roller axis direction (sheet width direction).

This embossed sheet forming apparatus therefore faces a difficulty in forming a both-sided high-precision embossed sheet that the embossing phase deviation of the front and rear surfaces falls within a tolerance.

SUMMARY OF THE INVENTION

The present invention has been completed with the above issues in mind and has an object to provide an embossed sheet forming apparatus and a related rotary phase difference control method for preventing the cyclic remarkable embossing phase deviation of the front and rear surfaces of a both-sided embossed sheet, which arises from the fluctuation of the rotary phase difference of two embossing rollers, and for allowing the embossing phase deviation to fall within a tolerance.

A first aspect of the present invention provides an embossed sheet forming apparatus having first and second embossing rollers juxtaposed in parallel with each other to allow the first and second embossing rollers to form a both-sided embossed sheet, comprising first-roller rotational origin position detecting means for detecting a rotational origin position of the first embossing roller, second-roller rotational origin position detecting means for detecting a rotational origin position of the second embossing roller, rotary phase difference computing means for computing a rotary phase difference equivalent to a difference between the rotational origin position of the first embossing roller detected by the first-roller rotational origin position detecting means and the rotational origin position of the second embossing roller detected by the second-roller rotational origin position detecting means, and rotary phase difference correction-amount computing means for computing a correction amount to correct a rotary speed ratio between the first and second embossing rollers such that when fluctuation occurs in a rotary phase difference computed by the rotary phase deviation computing means, the fluctuation in the rotary phase difference is cancelled, wherein the rotary speed ratio between the first and second embossing rollers is corrected based on the correction amount computed by the rotary phase difference correction-amount computing means.

A second aspect of the present invention provides a method of controlling a rotary phase difference of an embossing sheet forming apparatus having first and second embossing rollers juxtaposed in parallel with each other to allow the first and second embossing rollers to form a both-sided embossed sheet, comprising detecting a rotary phase difference between the first embossing roller and the second embossing roller, and correcting a rotary speed ratio between the first and second embossing rollers so as to cancel a deviation of the rotary phase difference when fluctuation occurs in the rotary phase difference.

DETAILED DESCRIPTION OF THE PREFERRED EMBODIMENT

Figure 2:
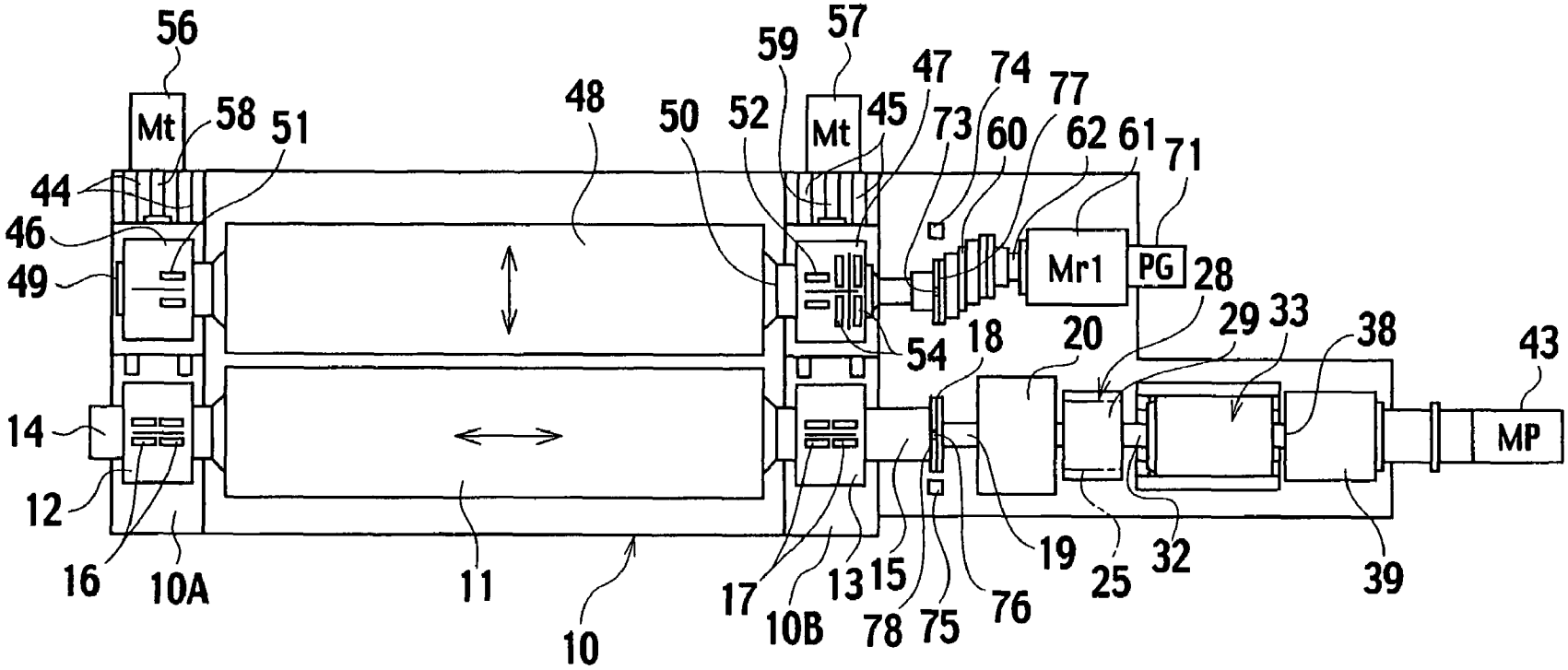
FIG. 2 is a plane view showing one embodiment of an embossed sheet forming apparatus according to the present invention.
Figure 3:
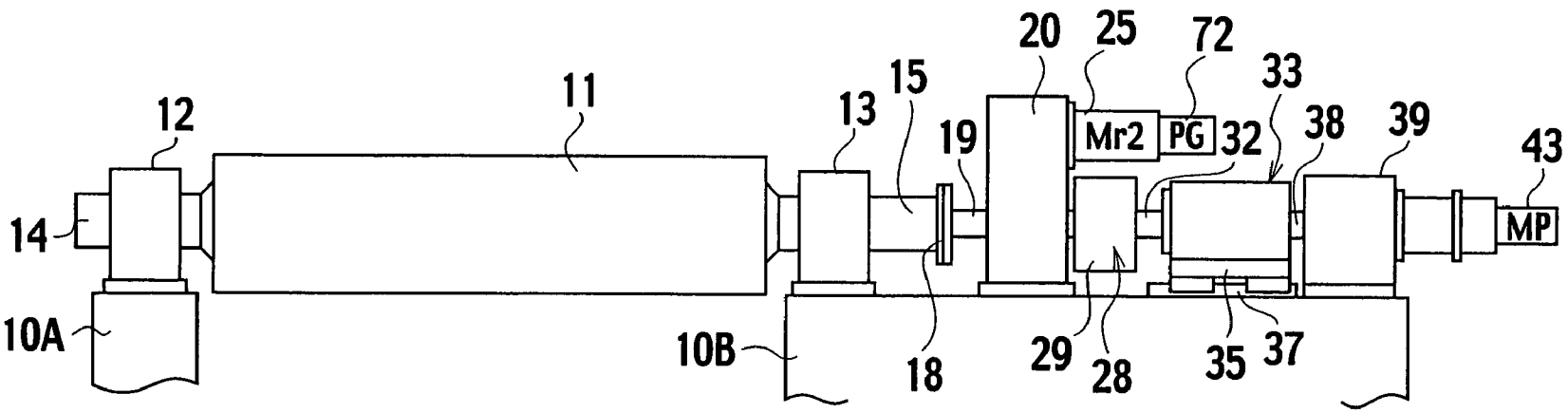
FIG. 3 is a front view of a roller targeted for adjusting an axial phase in one embodiment of the embossed sheet forming apparatus according to the present invention.

An embossed sheet forming apparatus of one embodiment according to the present invention is described with reference to FIGS. 2 to 4.

The embossed sheet forming apparatus includes a frame 10 as a base. The frame 10 has an operating station 10A and a driving station 10B, those on which roller bearing boxes 12, 13 are fixedly mounted.

The roller bearing boxes 12, 13 have roller radial bearings 16, 17 that support roller shafts 14, 15, the support roller shafts 14, 15 integrally formed with both ends of a second embossing roller 11, respectively. The roller radial bearings 16, 17 allow the second embossing roller 11 to be rotatable about a center axis thereof and to be movable in the center axis direction.

The operating station 10A and the driving station 10B of the frame 10 have linear guides 44, 45 that carry on roller bearing boxes 46, 47, respectively. The roller bearing boxes 46, 47 are configured to be movable toward and away from the second embossing roller 11 in a radial direction thereof (vertical direction in FIG. 2).

The roller bearing boxes 46, 47 include roller radial bearings 51, 52 that support roller shafts 49, 50, the roller shafts 49, 50 integrally mounted on both ends of a first embossing roller 48, respectively, with a roller thrust bearing 54 (mounted only in the roller bearing box 47). The roller radial bearings 51, 52 allow the first embossing roller 48 to be rotatable about a central axis thereof without axial movement (lateral movement in FIG. 2).

The first and second embossing rollers 48, 11 face with each other in parallel and play a role as embossing rollers that have outer peripheral surfaces, each of which is engraved with a circumferentially formed recess-shape embossing pattern (not shown).

The second embossing roller 11 has a roller shaft 15, carrying on a second roller measurement reference ring 78, in a driving side thereof. Mounted on the frame 10 at a position close proximity to the second roller measurement reference ring 78 is a second-roller rotational origin position sensor (second-roller rotational origin position detecting means) 75 such as a proximity switch. The second-roller rotational origin position sensor 75 senses a rotational origin position detection magnet 76 mounted on the second roller measurement reference ring 78 to detect a rotational origin position of the second embossing roller 11.

Figure 4:
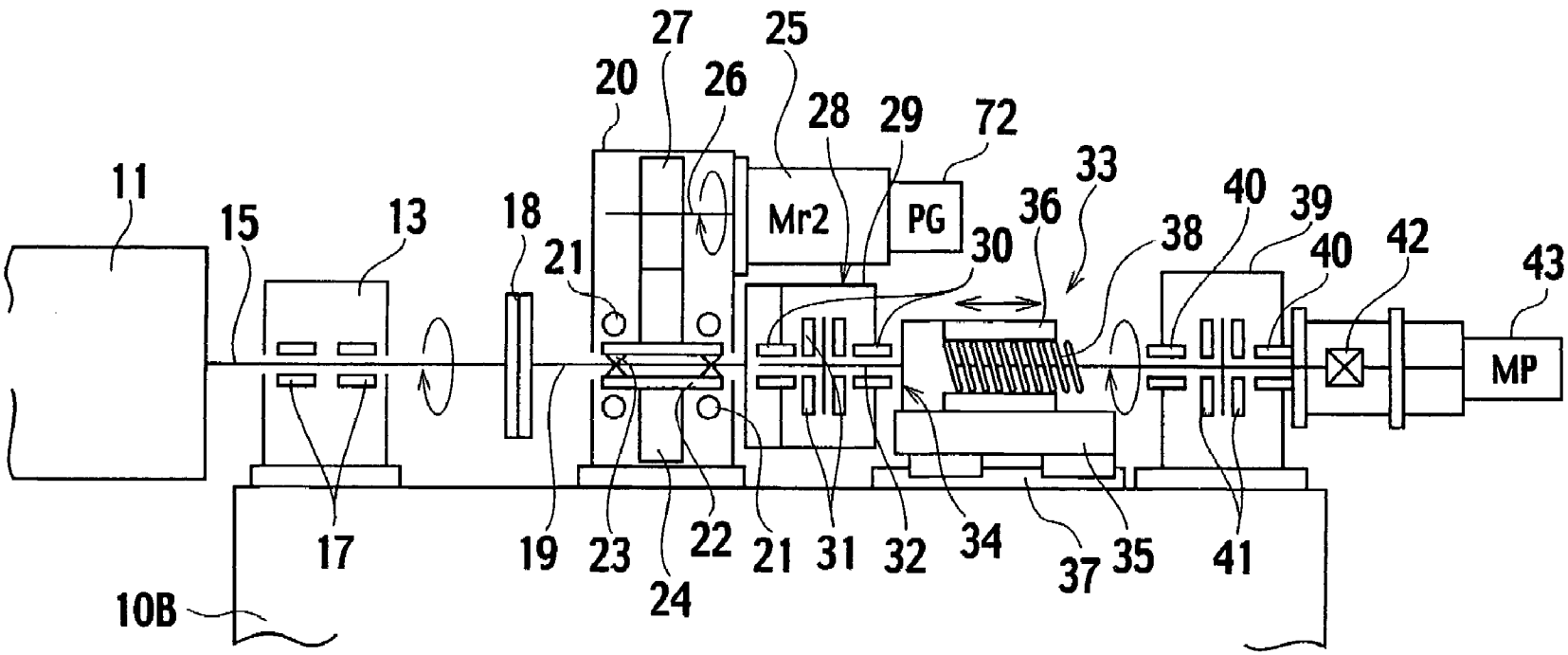
FIG. 4 is a skeletal view of a drive system and a phase control system of the roller targeted for adjusting the axial phase in one embodiment of the embossed sheet forming apparatus according to the present invention.

As shown in FIG. 4, the roller shaft 15 has one axial end connected to a roller drive shaft 19 by means of a coupling (flange coupling) 18. The roller drive shaft 19 extends in a roller axis direction thereof through a gear box 20 fixedly mounted on the frame 10 at the driving station 10B and a hollow gear shaft 22 rotatably supported by a roller radial bearing 21 in the gear box 20.

The roller drive shaft 19 is coupled to the hollow gear shaft 22 by means of a slide key, a spline 23, or the like with a torque transcript relationship satisfying displacing capability in the roller axis direction. The hollow gear shaft 22 carries on a drive gear 24. Mounted inside the gear box 20 is a second roller drive motor (servomotor) 25 with a reduction gear unit.

Mounted on an output shaft 26 of the second roller drive motor 25 is an output gear 27 that is held in meshing engagement with the drive gear 24. Mounted on the second roller drive motor 25 is a pulse generator (rotary position detector) 72 for detecting a motor rotating position of the second roller drive motor 25.

The second roller drive motor 25 generates rotational force that is transcribed to the roller shaft 15 through the motor shaft 26, the output gear 27, the drive gear 24, the slide key or the spline 23, the roller drive shaft 19 and the coupling 18. This transmission of the rotational force causes the second embossing roller 11 to rotate about the center axis thereof.

The roller drive shaft 19 has an axial end that is connected to a shift member 34 of a phase controller means 33 in a roller axis direction (widthwise direction of a product) by means of a rotary sliding coupling 28. The rotary sliding coupling 28 includes a rotary case 29, to which an axial end of the roller drive shaft 19 is fixedly connected, and a coupling shaft 32 disposed in coaxial relationship with the roller drive shaft 19. The coupling shaft 32 is support to a radial rotary bearing 30 mounted in the rotary case 29 and a thrust roller bearing 31 for relative rotation capability without movement in an axial direction (roller axis direction).

The rotary sliding coupling 28 shuts off the transmission of the rotation of the roller drive shaft 19 to the shift member 34 by means of the combination of the radial roller bearing 30 and the thrust roller bearing 31, while permitting an axial force of the shift member 34 to be transcribed to the roller drive shaft 19. The thrust roller bearing 31 is also applied with a preload such that the rotary case 29 is connected to the coupling shaft 32 without looseness in the roller axis direction.

The shift member 34 of the phase controller means 33 is comprised of a slide base 35 and a ball-nut member 36 fixedly secured to the slide base 35 without rotation. The shaft member 34 is movable in the same direction as the roller axis direction by means of a linear guide 37 mounted on the driving station 10B of the frame 10. The ball-nut member 36 is coaxially aligned with a central axis of the second embossing roller 11 and held in screwing engagement with a ball screw rod 38.

The ball screw rod 38 is rotatably supported by a radial roller bearing 40 and a thrust roller bearing 41 mounted in a bearing box 39 and drivably connected to an output shaft (not shown) of a phase control reduction gear motor (servomotor) 43 by means of a shaft coupling 42.

When the phase control reduction gear motor (servomotor) 43 rotatably drives the ball screw rod 38, the shift member 34 involving the ball-nut member 36 is shifted in the same direction as the roller axis direction. Since such shifting movement is transcribed to the roller drive shaft 19 and the roller shaft 15 through the rotary slide coupling 28, the second embossing roller 11 is axially moved. With such axial movement, phase control is performed in the roller axis direction.

The bearing boxes 46, 47 of the first embossing roller 48 are moved in parallel with each other in a roller-to-roller gap direction (radial direction of the roller) by means of feed screws 58, 59 driven by roller-to-roller gap adjustment motors 56, 57, respectively. With such movements, a roller-to-roller gap between the first and second embossing rollers 11, 48 is adjusted.

The roller shaft 50 of the driven station of the first embossing roller 48 has a first roller measurement reference ring 77. The frame 10 carries on a first-roller rotational origin position sensor (first-roller rotational origin position detecting means) 73 such as a proximity switch, at a position close proximity to the first roller measurement reference ring 77. The first-roller rotational origin position sensor 73 senses a rotational origin position detection magnet 74 mounted on the first roller measurement reference ring 77 to detect a rotational origin position of the first embossing roller 48.

The roller shaft 50 has an axial end drivably connected to a motor shaft 62 of a first roller drive motor (servomotor) 61 by means of a constant velocity universal joint 60 using a Schmidt coupling and others.

The first roller drive motor 61 is of a type that includes a reduction gear and generates rotational force of the first roller drive motor 61 that is transcribed to the roller shaft 50 through motor shaft 62 and the constant velocity universal joint 60. This transmission of the rotational force causes the first embossing roller 48 to rotate about a central axis thereof. Mounted onto the first roller drive motor 61 is a pulse generator (rotary position detector) 71 for detecting a motor rotary position of the first roller drive motor 61.

A T-die (not shown) is located in a position just above a gap portion between the first and second embossing rollers 11, 48. The T-die supplies embossing sheet forming resin to the gap portion between the first and second embossing rollers 11, 48 under a melted condition. Melted resin supplied to the gap portion between the first and second embossing rollers 11, 48 is formed in a sheet-like configuration between the rollers by extrusion molding. After an embossed sheet (product) whose both surfaces are embossed is produced, the following step is executed.

Figure 5:
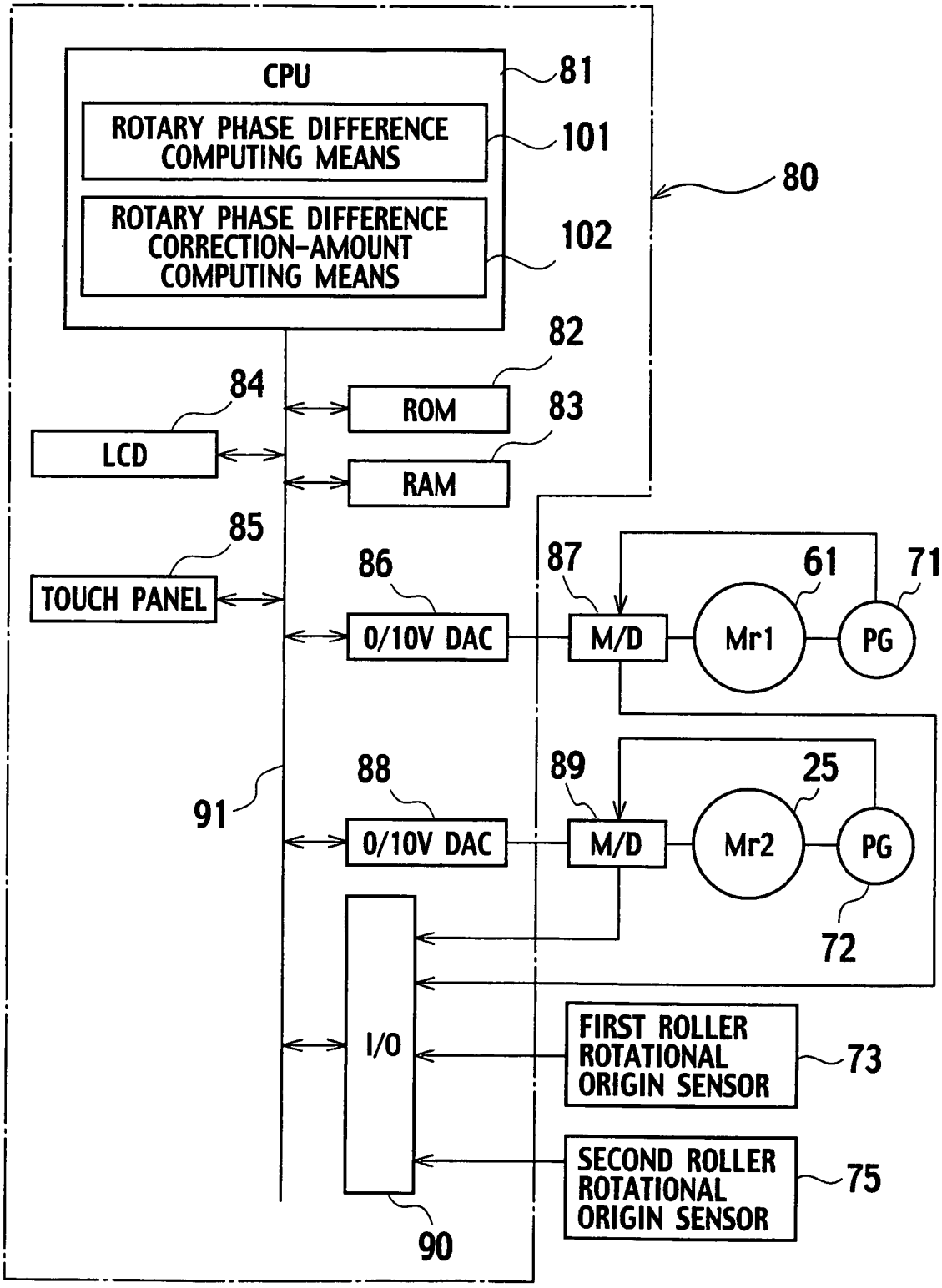
FIG. 5 is a block diagram showing one embodiment of a control system of the embossed sheet forming apparatus according to the present invention.

One embodiment of a control system for controlling a rotary phase difference with the embossed sheet forming apparatus according to the present invention is explained with reference to FIG. 5.

The embossing sheet forming apparatus performs rotary phase difference control using a microcomputer 80. The microcomputer 80 includes a CPU for executing various computing operations, a ROM 82 storing an operational sequence and computer programs, a RAM 83 used for working memories, a liquid crystal display 84, a touch panel 85, D/A converters 86, 88, and I/O port (interface) 90.

Connected to the D/A converter 86 is a motor driver 87 for the first roller drive motor 61. Connected to the D/A converter 88 is a motor driver 89 for the second roller drive motor 25.

Based on a command, inputted from the microcomputer 80, for rotation of the first embossing roller and a pulse signal, inputted from the pulse generator 71, resulting from detecting a motor rotary position of the first roller drive motor 61, the motor driver 87 drives the first roller drive motor 61, that is, rotates the first embossing roller 48 in feedback control.

Based on a command, inputted from the microcomputer 80, for rotation of the second embossing roller and a pulse signal, inputted from the pulse generator 72, resulting from detecting a motor rotary position of the second roller drive motor 25, the motor driver 89 drives the second roller drive motor 25, that is, rotates the second embossing roller 11 in feedback control.

The microcomputer 80 has the I/O port 90 to which the motor drivers 87, 89 and the first and second roller rotational origin position sensors 73, 75 are connected. The microcomputer 80 is thus applied with pulse signals (rotary position detection signals) output from the pulse generators 71, 72, a rotational origin position signal of the first embossing roller 48 delivered from the first-roller rotational origin position sensor 73, and a rotational origin position signal of the second embossing roller 11 delivered from the second-roller rotational origin position sensor 75.

The CPU 81 of the microcomputer 80 realizes a rotary phase deviation computing means 101 and a rotary phase-deviation correction-amount computing means 102 by executing various computer programs.

The rotary phase difference computing means 101 computes a rotary phase difference ΔP, which is equivalent to a difference in a rotational direction between a rotational origin position of the first embossing roller 48 and a rotational origin position of the second embossing roller 11. Here the rotational origin position of the first embossing roller 48 is detected by the first roller rotational origin position sensor 73, and the rotational origin position of the second embossing roller 11 is detected by the second roller rotational origin position sensor 75. In particular, the rotary phase difference computing means 101 computes the rotary phase difference ΔP by counting either one of pulse signals delivered from the pulse generators 71, 72, during a time interval between a time when the first roller rotational origin position sensor 73 detects the rotational origin position of the first embossing roller 48 and a time when the second roller rotational origin position sensor 75 detects the rotational origin position of the second embossing roller 11. Here the pulse signals is PG-frequency-divided pulses in the present embodiment.

When the rotary phase difference ΔP computed by the rotary phase difference computing means 101 is varied, the rotary phase difference correction-amount computing means 102 computes a draw ratio correction amount Cd for correcting a rotary speed ratio (draw ratio) between the first and second embossing rollers 48, 11 so as to cancel the deviation of the rotary phase difference ΔP. In particular, the rotary phase difference correction-amount computing means 102 computes the draw ratio correction amount Cd with the following steps: (1) By subtracting a reference value ΔPd from a rotary phase difference ΔPr, where the reference value ΔPd is the average value of the rotary phase difference ΔP at a time when the reference value ΔPd is set up, and the rotary phase difference ΔPr is a rotary phase difference at a time when the rotary phase difference ΔP is corrected; (2) By multiplying the difference (ΔPr−ΔPd) by a correction coefficient (%/deg.). Here the correction coefficient (%/deg.) is set up on the touch panel 85.

The time when the reference value ΔPd of the rotary phase difference ΔP is set up can be regarded to be a time at which a preset button is pressed on the touch panel 85. The time when the rotary phase difference ΔP is corrected may be cyclically determined for a specified seconds time interval, a specified number of rotations, or the like.

The microcomputer 80 corrects the rotary speed ratio of the first and second embossing rollers 48, 11, based on the draw ratio correction amount Cd computed by the rotary phase difference correction-amount computing means 102.

With the correction of such a rotary speed ratio, the difference (ΔPr−ΔPd) of the rotary phase difference is cancelled, thereby avoiding the variation of the rotary phase difference of the first and second embossing rollers 48, 11.

This can avoids cyclic remarkable embossing phase deviation on the front and rear surfaces of an embossed sheet, which arises from the fluctuation of the rotary phase difference of the first and second embossing rollers 48, 11, and consequently, a double-sided high precision embossed sheet can be formed with a embossing phase deviation falling within a tolerance.

Figure 1A:
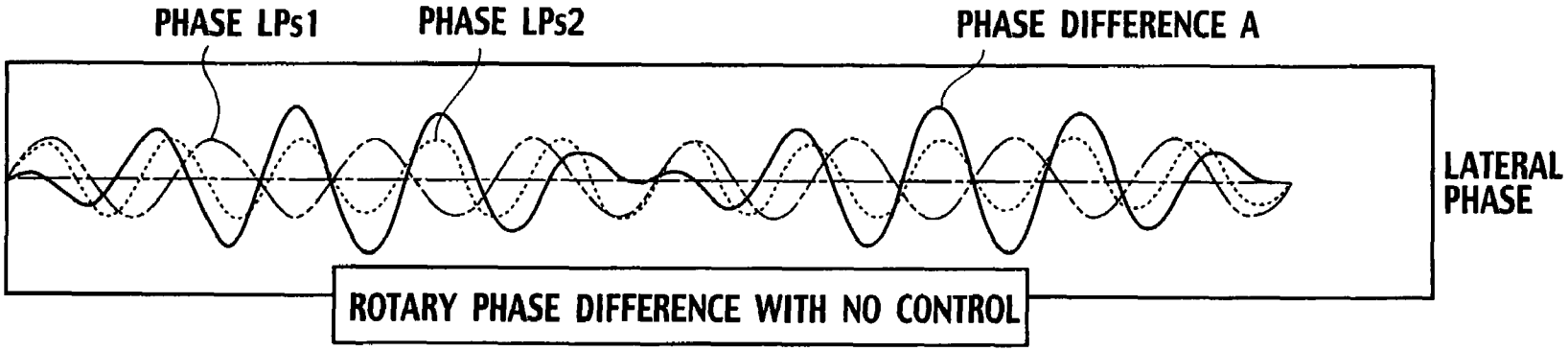
FIG. 1A is a graph illustrating a phase difference in a both-sided embossed sheet formed by an embossed sheet forming apparatus of the related art.
Figure 1B:
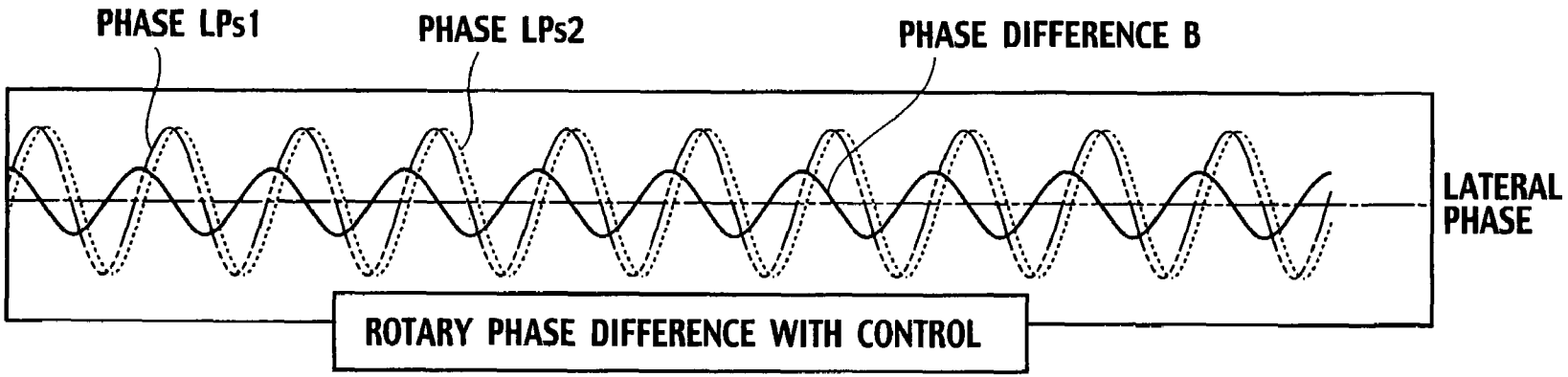
FIG. 1B is a graph illustrating a phase difference in a both-sided embossed sheet formed by an embossed sheet forming apparatus according to the present invention.

FIG. 1B shows a phase difference B between an embossing phase LPs1 in the axis direction of an upper roller, which corresponds to a front surface of a both-sided embossed sheet, and an embossing phase LPs2 in the axis direction of a lower roller, which corresponds to a rear surface of the both-sided embossed sheet, according to the embossed sheet forming apparatus of the present embodiment. The phase difference B shows that any remarkable embossing phase deviation does not cyclically occur on the front and rear surfaces of the both-sided embossed sheet along a widthwise direction thereof, and the embossing phase deviation falls within a tolerance.

The entire content of Japanese Patent Application No. P2005-123749 with a filing data of Apr. 21, 2005 of which is expressly incorporated herein by reference in its entirety.

What is claimed is:

1. An embossed sheet forming apparatus having first and second embossing rollers juxtaposed in parallel with each other to allow the first and second embossing rollers to form a both-sided embossed sheet by pressing opposite sides of the same sheet, comprising:

first-roller rotational origin position detecting means for detecting a rotational origin position of the first embossing roller;

second-roller rotational origin position detecting means for detecting a rotational origin position of the second embossing roller;

rotary phase difference computing means for computing a rotary phase difference equivalent to a difference between the rotational origin position of the first embossing roller detected by the first-roller rotational origin position detecting means and the rotational origin position of the second embossing roller detected by the second-roller rotational origin position detecting means; and rotary phase difference correction-amount computing means for computing a correction amount to correct a rotary speed ratio between the first and second embossing rollers such that when fluctuation occurs in a rotary phase difference computed by the rotary phase difference computing means, the fluctuation in the rotary phase difference is cancelled;

wherein the rotary speed ratio between the first and second embossing rollers is corrected based on the correction amount computed by the rotary phase difference correction-amount computing means; and wherein the rotary phase difference correction-amount computing means computes a reference value based on an average value of the rotary phase difference at a time when the reference value is established, computes a fluctuation amount based on a difference between the reference value and the rotary phase difference at a time when the rotary phase difference is corrected, and computes the correction amount based on the fluctuation amount.

2. The embossed sheet forming apparatus according to claim 1, further comprising:

a first roller drive motor with a rotary position detector for rotatably driving the first embossing roller; and a second roller drive motor with a rotary position detector for rotatably driving the second embossing roller;

wherein the rotary phase difference correction-amount computing means inputs a rotary position detection signal from one of the rotary position detectors of the first and second roller drive motors to compute the rotary phase difference based on the rotary position detection signal appearing from a time when the first roller rotational origin position detecting means detects the rotational origin position of the first embossing roller to a time when the second roller rotational origin position detecting means detects the rotational origin position of the second embossing roller.

3. The embossed sheet forming apparatus according to claim 1, wherein the rotary phase difference correction-amount computing means computes the correction amount based on a value obtained by multiplying the fluctuation amount of the rotary phase difference by a correction coefficient.

4. A method of controlling a rotary phase difference of an embossed sheet forming apparatus having first and second embossing rollers juxtaposed in parallel with each other to allow the first and second embossing rollers to form a both-sided embossed sheet by pressing opposite sides of the same sheet, comprising:

detecting a rotary phase difference between the first embossing roller and the second embossing roller; and correcting a rotary speed ratio between the first and second embossing rollers so as to cancel a deviation of the rotary phase difference when fluctuation occurs in the rotary phase difference;

wherein the correcting step further comprises:

computing a reference value based on an average value of the rotary phase difference at a time when a reference value is established;

computing a fluctuation amount based on a difference between the reference value and the rotary phase difference at a time when the rotary phase difference is corrected; and computing the correction amount based on the fluctuation amount.

* * * * *

UNITED STATES PATENT AND TRADEMARK OFFICE

CERTIFICATE OF CORRECTION

PATENT NO. : 7,587,975 B2
APPLICATION NO. : 11/404798
DATED : September 15, 2009
INVENTOR(S) : Natsume et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 406 days.

Signed and Sealed this

Fourteenth Day of December, 2010

David J. Kappos

David J. Kappos
*Director of the United States Patent and Trademark Office*